US007546064B2

(12) United States Patent
Yoshino et al.

(10) Patent No.: US 7,546,064 B2
(45) Date of Patent: Jun. 9, 2009

(54) PROCESS CARTRIDGE WITH IMAGE CARRIER SUPPORTING STRUCTURE FOR USE IN AN IMAGE FORMING APPARATUS

(75) Inventors: Kaoru Yoshino, Tokyo (JP); Satoshi Takano, Tokyo (JP); Hiroshi Ono, Tokyo (JP); Takeshi Shintani, Kanagawa (JP); Satoshi Hatori, Kanagawa (JP); Akira Fujimori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 330 days.

(21) Appl. No.: 11/520,684

(22) Filed: Sep. 14, 2006

(65) Prior Publication Data

US 2007/0059035 A1 Mar. 15, 2007

(30) Foreign Application Priority Data

Sep. 14, 2005 (JP) ..... 2005-266568

(51) Int. Cl.
*G03G 15/00* (2006.01)
*G03G 21/16* (2006.01)

(52) U.S. Cl. ..... 399/117; 399/108; 399/111

(58) Field of Classification Search ..... 399/111, 399/116, 117, 108
See application file for complete search history.

(56) References Cited

U.S. PATENT DOCUMENTS

| | | | | |
|---|---|---|---|---|
| 4,839,690 | A * | 6/1989 | Onoda et al. | 399/117 |
| 5,870,654 | A * | 2/1999 | Sato et al. | 399/109 |
| 6,175,705 | B1 * | 1/2001 | Harada et al. | 399/117 |
| 6,549,738 | B2 * | 4/2003 | Otani et al. | 399/117 |
| 2005/0169663 | A1 | 8/2005 | Shintani et al. | |
| 2006/0110184 | A1 | 5/2006 | Yoshino et al. | |

FOREIGN PATENT DOCUMENTS

| | | |
|---|---|---|
| JP | 04-301653 | 10/1992 |
| JP | 04-340975 | 11/1992 |

(Continued)

OTHER PUBLICATIONS

U.S. Appl. No. 11/935,106, filed Nov. 5, 2007, Muraishi et al.

(Continued)

*Primary Examiner*—David M Gray
*Assistant Examiner*—Joseph S. Wong
(74) *Attorney, Agent, or Firm*—Oblon, Spivak, McClelland, Maier & Neustadt, P.C.

(57) ABSTRACT

A process cartridge and an image carrier supporter for use in an image forming apparatus. The image carrier supporter temporarily fixes an image carrier inside a process cartridge of an image forming apparatus. The image carrier supporter includes a penetration shaft, and first and second fixing members. The penetration shaft includes first and second ends, and penetrates through a center throughhole of the image carrier. The first and second fixing members are provided at the first and second ends, respectively, of the penetration shaft, and are configured to closely contact a circumferential inner surface of the image carrier and a frame of a process cartridge, respectively. The process cartridge is configured to be attachable to and detachable from the image forming apparatus, and includes a frame, the image carrier, the image carrier supporter, and a process mechanism configured to form an image on the image carrier.

11 Claims, 11 Drawing Sheets

FOREIGN PATENT DOCUMENTS

| | | |
|---|---|---|
| JP | 08-339155 | 12/1996 |
| JP | 10-104996 | 4/1998 |
| JP | 10-153940 | 6/1998 |
| JP | 11-167333 | 6/1999 |
| JP | 11-218983 | 8/1999 |
| JP | 2001-249604 | 9/2001 |
| JP | 2002-214869 | 7/2002 |
| JP | 2002-278364 | 9/2002 |
| JP | 2003-005475 | 1/2003 |
| JP | 2005-043427 | 2/2005 |
| JP | 2005-215272 | 8/2005 |

OTHER PUBLICATIONS

U.S. Appl. No. 11/855,353, filed Sep. 14, 2007, Shintani et al.

* cited by examiner

PROCESS CARTRIDGE WITH IMAGE CARRIER SUPPORTING STRUCTURE FOR USE IN AN IMAGE FORMING APPARATUS

BACKGROUND OF THE INVENTION

1. Field of the Invention

The present invention generally relates to an image carrier supporter for use in a process cartridge, and more particularly to an image carrier supporter for use in a process cartridge capable of effectively preventing damage to the image carrier during transportation and/or storage.

2. Discussion of the Background

In general, a related-art image forming apparatus such as a copying machine, a printer, a facsimile machine, etc., employing an electrophotographic method is provided with an image forming engine made based on a state-of-the-art technology involving different engineering fields, such as mechanical, electrical, and even chemical arts. Therefore, the image forming engine is generally susceptible to changes in major factors of image forming, such as conditions of an image developer, wear and tear of constituent components, and so forth.

In many cases of the changes, the related-art image forming apparatuses will need a recovery by a repair service technician at a user site, resulting in a relatively high maintenance cost. This situation has been improved based on the results of various engineering developments. For example, the image developer is provided with a prolonged life time and the constituent components are ruggedized so that an occurrence frequency of changes to those elements is decreased. As a consequence, the frequency of visit by the repair service technician to the user site is accordingly decreased.

Furthermore, the related-art image forming apparatus has been provided with a marked improvement by introducing a process cartridge to the market. The process cartridge may be referred to as a conveniently-replaceable image forming engine unit, and integrally contains a photoconductor, a sensor unit, and at least one electrophotographic constituent unit, such as a charging unit, a development unit, and a cleaning unit. Such an integrated process cartridge is exchangeably installed in the related-art image forming apparatus to facilitate a maintenance work and to shorten maintenance time. That is, a repair service technician or even a user can easily exchange the process cartridge to correct a defect when the image forming process malfunctions.

Since the process cartridge is an exchangeable unit, as described above, it needs protection during transport and/or storage. That is, the process cartridge includes an image forming engine containing various precision components, and typically the photoconductor needs to be protected from being undesirably contacted by neighboring components.

Therefore, the process cartridge is commonly provided with a protection member to attempt to prevent the photoconductor from being damaged by an undesirable vibration during transport and/or storage.

From a structural viewpoint, the process cartridge bears a technical dilemma on how to efficiently hold the photoconductor during transport and/or storage. That is, to prevent the photoconductor from an undesirable contact with a neighboring element, it is preferable to fixedly hold the photoconductor. In this case, however, the position of the photoconductor cannot be adjusted when the process cartridge is installed at a predetermined place in the related-art image forming apparatus. To allow an adjustment of the photoconductor position at an installation of the process cartridge, at least one end of the photoconductor facing a counterpart mechanism of the apparatus needs to be movably held. This may lead to an occurrence of an undesirable contact to a neighboring element within the process cartridge during transport and/or storage.

SUMMARY OF THE INVENTION

In view of the foregoing, it is an object of the present invention to provide a novel image carrier supporter for temporarily fixing an image carrier inside a process cartridge of an image forming apparatus during transport and/or storage of the process cartridge.

Another object of the present invention is to provide a novel process cartridge having an image carrier supporter for temporarily fixing an image carrier inside the process cartridge of an image forming apparatus during transport and/or storage of the process cartridge.

To achieve the above-mentioned objects and other objects, in one example, an image carrier supporter includes a penetration shaft, and first and second fixing members. The penetration shaft includes first and second ends, and penetrates through a center throughhole of an image carrier. The first and second fixing members are provided at the first and second ends, respectively, of the penetration shaft and are each configured to closely contact a circumferential inner surface of the image carrier and a frame of the process cartridge, respectively.

In another example, a process cartridge includes a frame, an image carrier, an image carrier supporter, and a process mechanism configured to form an image on the image carrier. The image carrier supporter includes a penetration shaft, and first and second fixing members. The penetration shaft includes first and second ends, and penetrates through a center throughhole of an image carrier. The first and second fixing members are provided at the first and second ends, respectively, of the penetration shaft and are each configured to closely contact a circumferential inner surface of the image carrier and a frame of the process cartridge, respectively.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
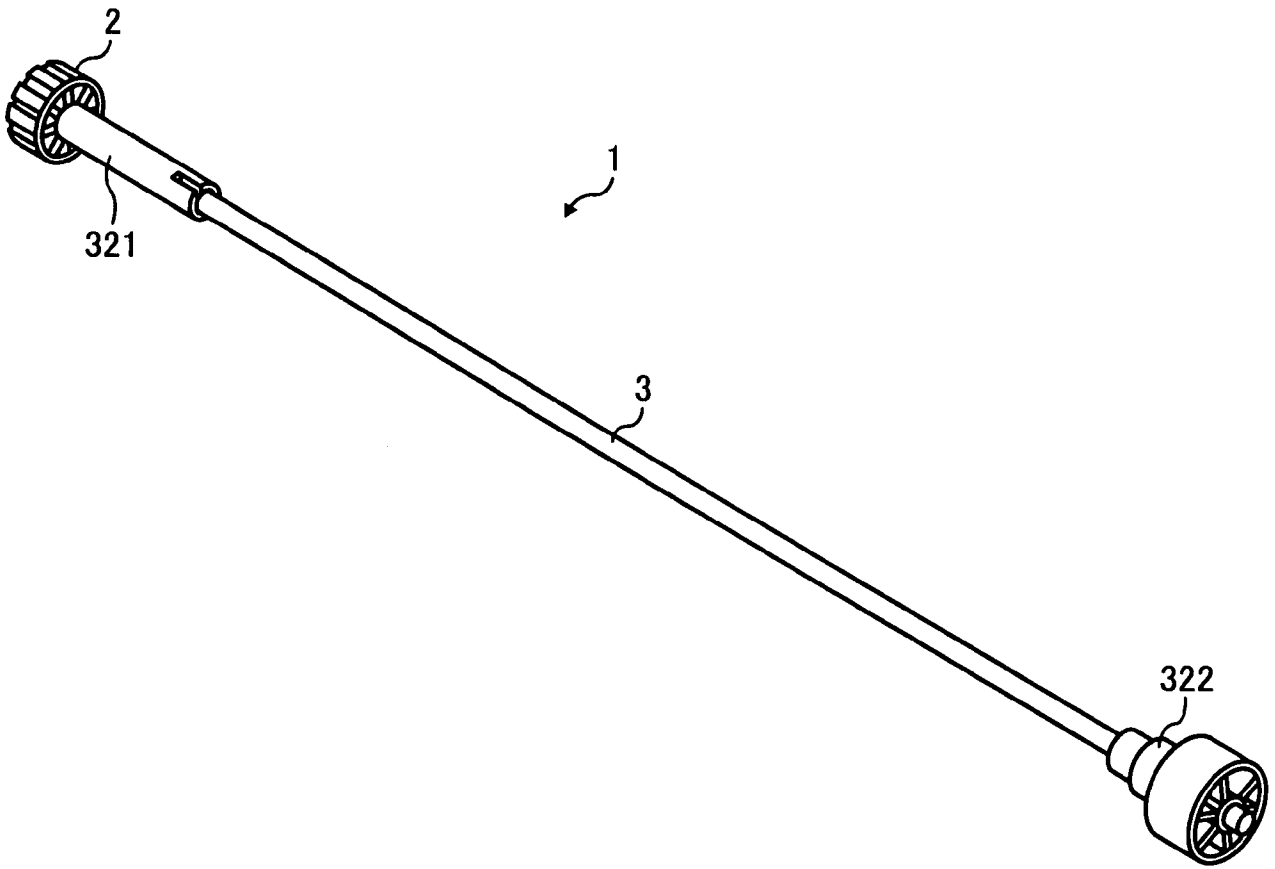
FIG. 1 is a perspective view of a photoconductor fixing jig according to an exemplary embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner.

Referring now to the drawings, wherein like reference numerals designate identical or corresponding parts throughout the several views, particularly to FIGS. 1 to 3A and 3B, a photoconductor fixing jig 1 according to an exemplary embodiment of the present invention is described.

The photoconductor fixing jig 1 of FIG. 1 is an image carrier supporter for temporarily fixing a photoconductor to a frame of a process cartridge used in an image forming apparatus. This photoconductor fixing jig 1 is configured to prevent damage on the photoconductor with a structure described below. Such damage may be caused due to an undesirable contact by unexpected vibrations and the like with a peripheral device such as a development unit when the process cartridge is singly transported or stored.

As illustrated in FIG. 1, the photoconductor fixing jig 1 includes an auxiliary fixing member 2, a center member 3, a front touching member 321, and a back touching member 322. The auxiliary fixing member 2 can be a screw member. The center member 3 is a columnar penetration shaft for penetrating an image carrier along a long side of the image carrier. Into the auxiliary fixing member 2, a screw part at the end of the center member 3 is screwed in a manner that the auxiliary fixing member 2 abuts against an end of the front touching member 321. To one end portion of the center member 3, the front touching member 321 that is a first fixing member is attached. The back touching member 322 is a second fixing member, and is attached to the other end of the center member 3. The center member 3 can be produced by cutting and coating a metal such as SUM22 that is a free-cutting steel. The front touching member 321, auxiliary fixing member 2, and back touching member 322 can be produced by molding a resin such as polystyrene.

Figure 2:
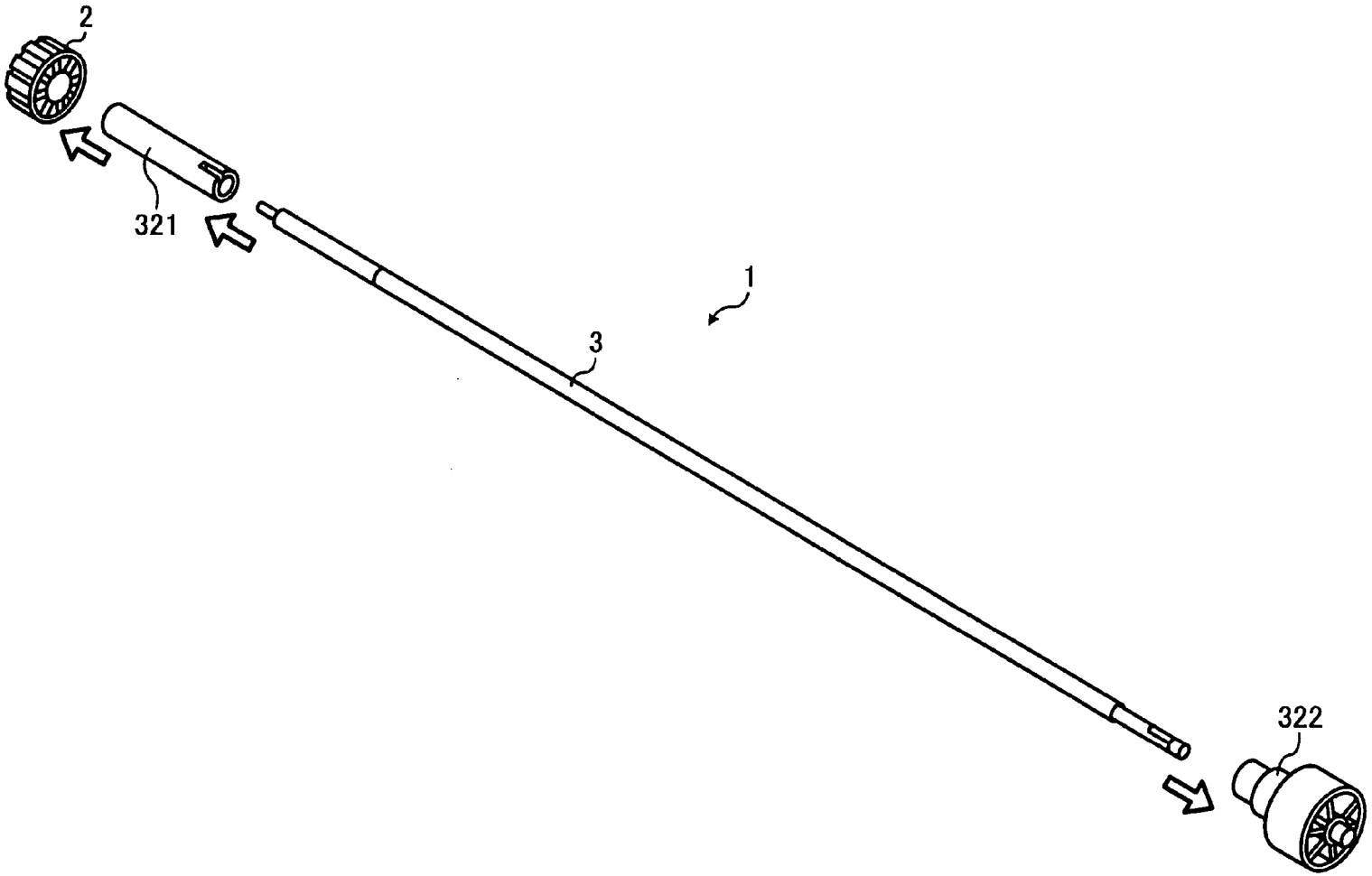
FIG. 2 is an exploded perspective view of the photoconductor fixing jig of FIG. 1.

As illustrated in FIG. 2, the auxiliary fixing member 2, front touching member 321, and back touching member 322 are configured to be attachable to and detachable from the center member 3 of the photoconductor fixing jig 1.

Figure 3A:
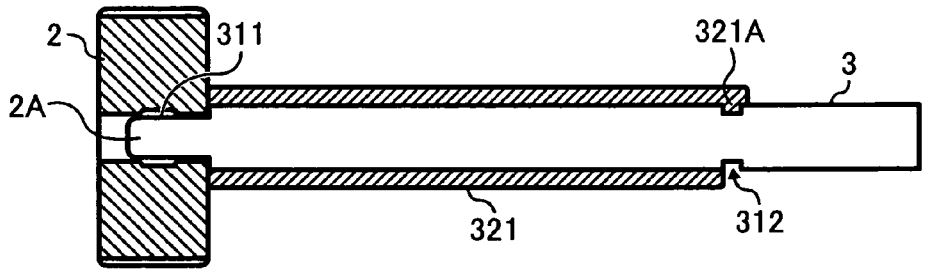
FIG. 3A is a partial cross-sectional schematic diagram illustrating the photoconductor fixing jig of FIG. 1 at a side of a front touching member.
Figure 3B:
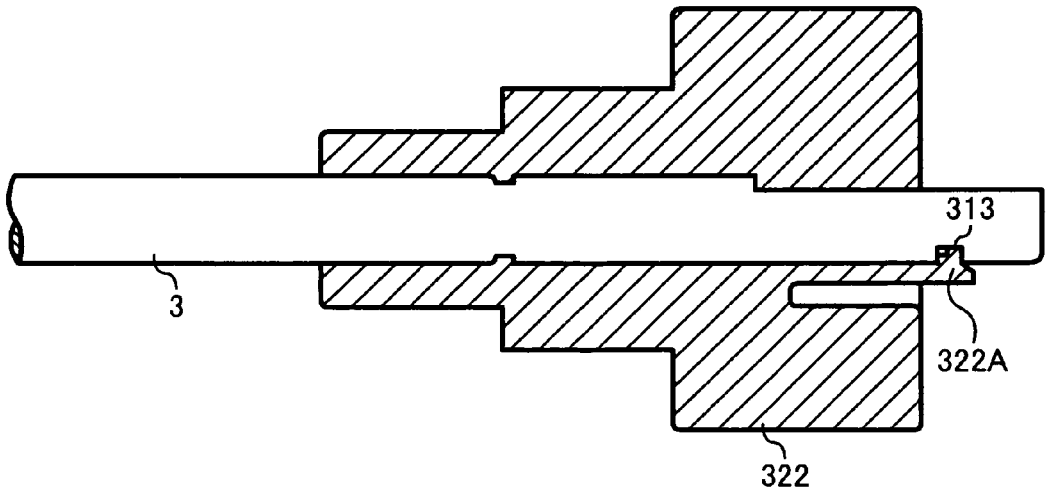
FIG. 3B is a partial cross-sectional schematic diagram illustrating the photoconductor fixing jig of FIG. 1 at a side of a back touching member.

As illustrated in FIGS. 3A and 3B, the center member 3 includes a center member male screw 311, a center member front groove 312, and a center member back groove 313. The auxiliary fixing member 2 includes an auxiliary fixing member female screw 2A. The front touching member 321 includes a front touching claw member 321 A, and the back touching member 322 includes a back touching claw member 322A. As illustrated in FIG. 3A, the front touching member 321 has a sleeve-like shape, and one end of the center member 3 is inserted therein. More specifically, the front touching claw member 321A provided at one end of the front touching member 321 engages with the center member front groove 312 in a manner that the front touching claw member 321A may be fitted in and extracted from the center member front groove 312. From the other end of the front touching member 321, the center member male screw 311 provided at the end of the center member 3 protrudes. The center member male screw 311 is screwed into the auxiliary fixing member female screw 2A provided inside the auxiliary fixing member 2, to attach the auxiliary fixing member 2 to the end of the center member 3. On the other hand, the other end of the center member 3 is inserted into the back touching member 322 as illustrated in FIG. 3B. The back touching claw member 322A provided at an end of the back touching member 322 engages with the center member back groove 313, to fix the back touching member 322 to the center member 3.

The photoconductor fixing jig 1 is a fixing member for temporarily fixing an image carrier to a process cartridge frame. This photoconductor fixing jig 1 may prevent damage on the photoconductor due to contact with a peripheral device such as a development unit caused by vibration and the like when the process cartridge is singly transported or stored.

Figure 4A:
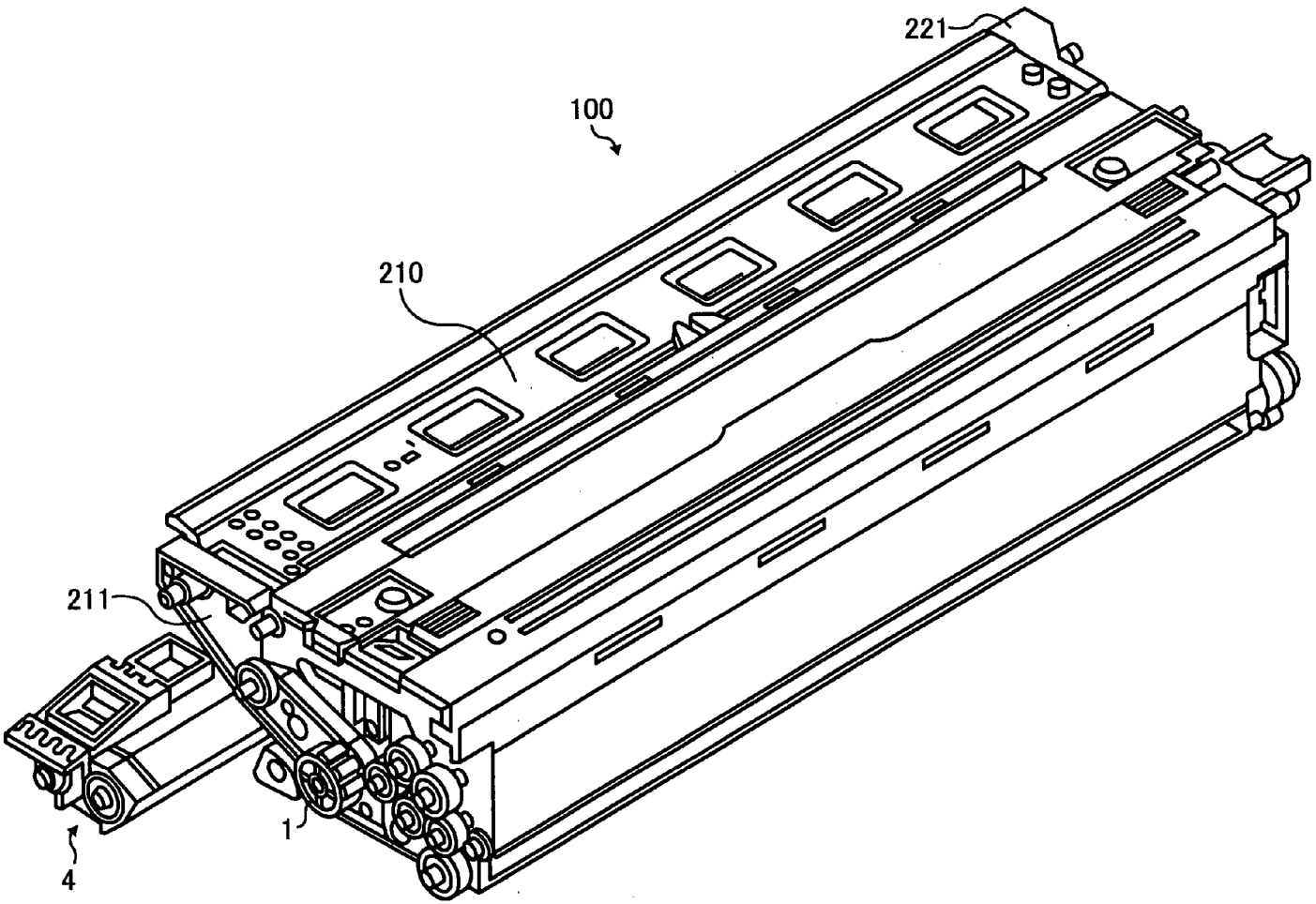
FIG. 4A is a perspective view of a process cartridge according to an exemplary embodiment of the present invention.
Figure 4B:
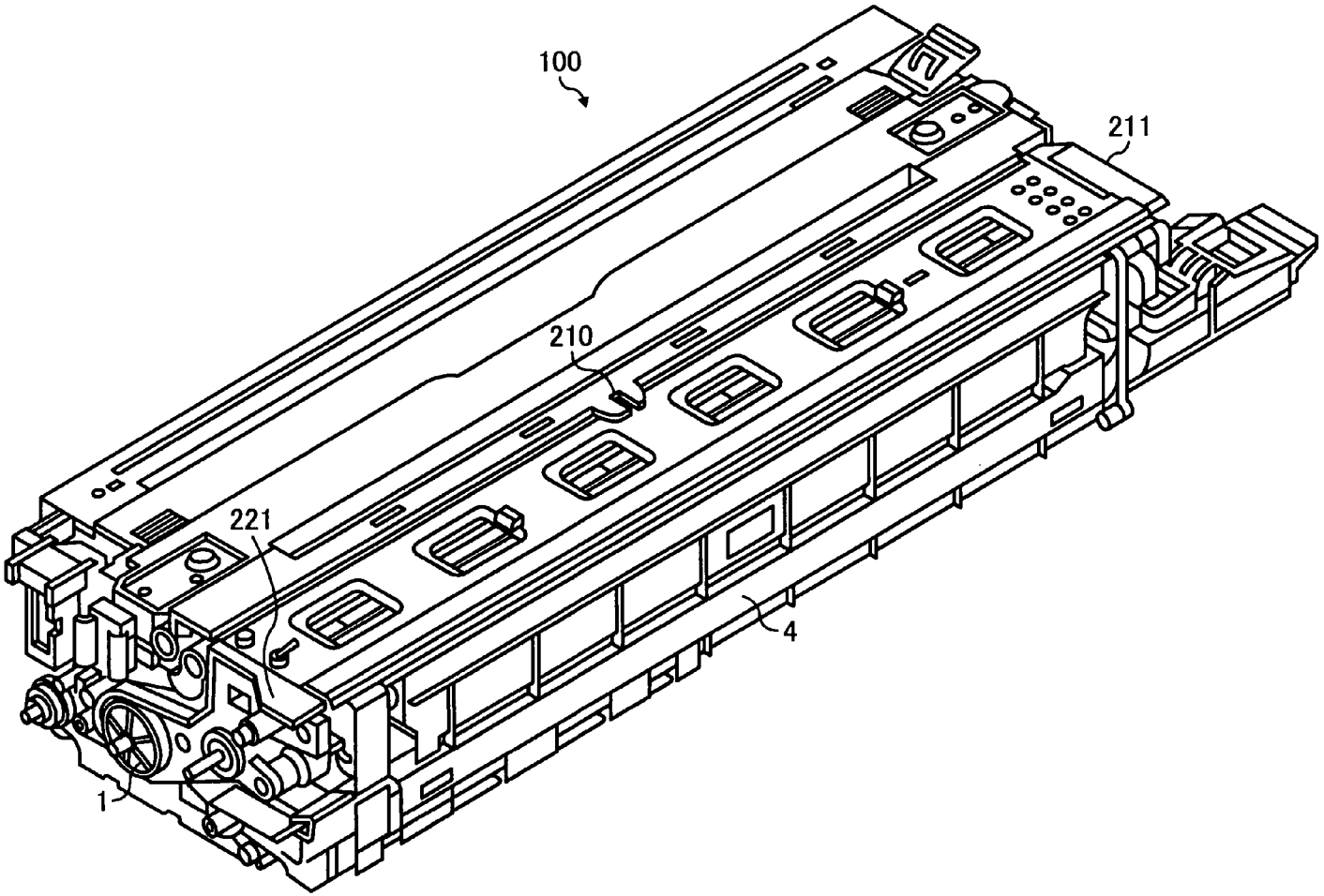
FIG. 4B is another perspective view of the process cartridge of FIG. 4A, seen from an opposite side.

Next, a process cartridge according to an exemplary embodiment of the present invention is described. As illustrated in FIGS. 4A and 4B, the process cartridge 100 includes a development unit 4, a process cartridge frame 210, a front plate 211, and a back plate 221. In FIGS. 4A and 4B, the photoconductor fixing jig 1 is attached to the process cartridge 100. The development unit 4 is a process mechanism that affects the image carrier. Each of the front plate 211 and back plate 221 forms a part of the process cartridge frame 210, and determines a positional relationship between a process unit such as the development unit 4 and the process cartridge frame 210.

Figure 5A:
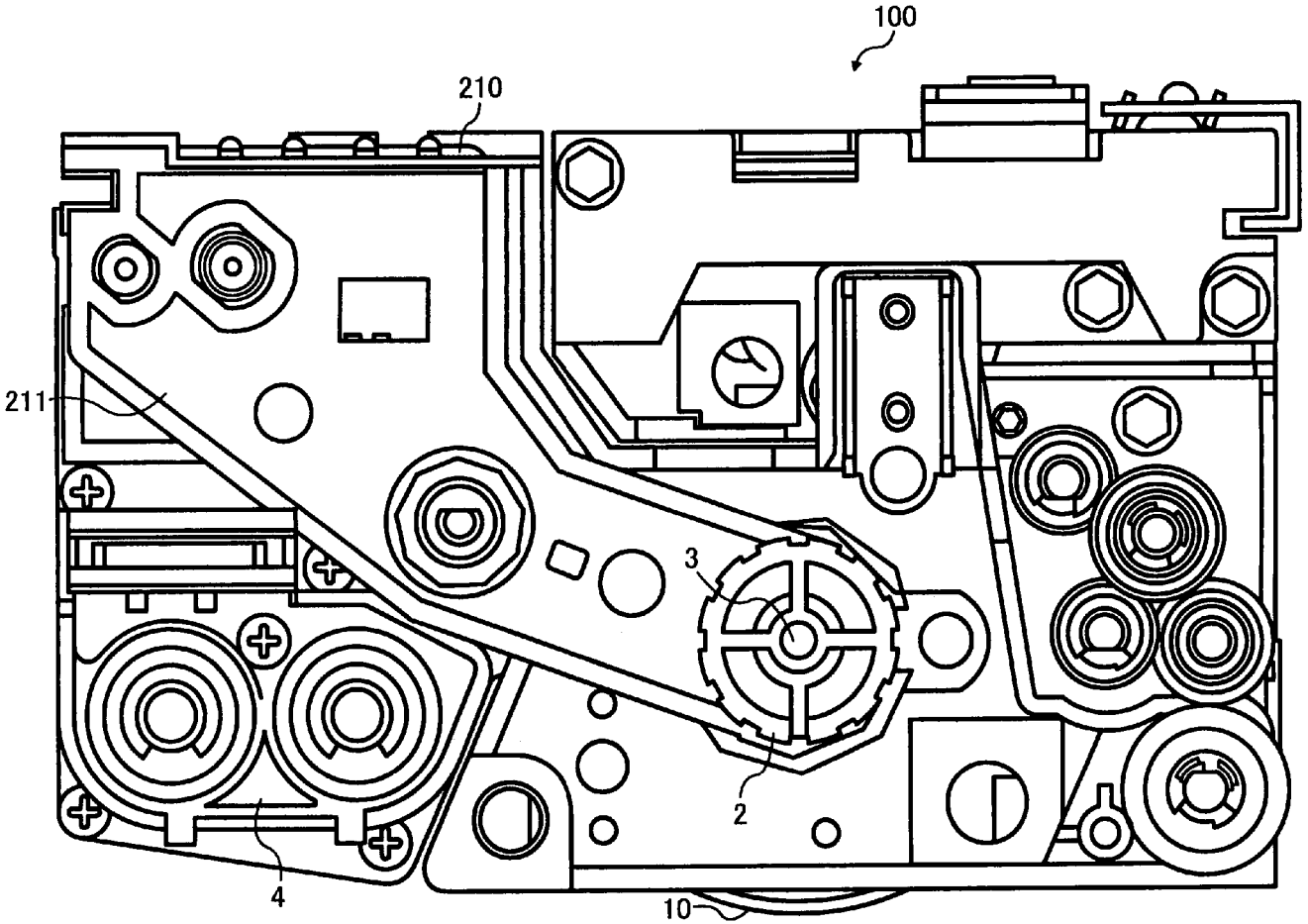
FIG. 5A is a plan view of the process cartridge, seen from a side of a front plate.
Figure 5B:
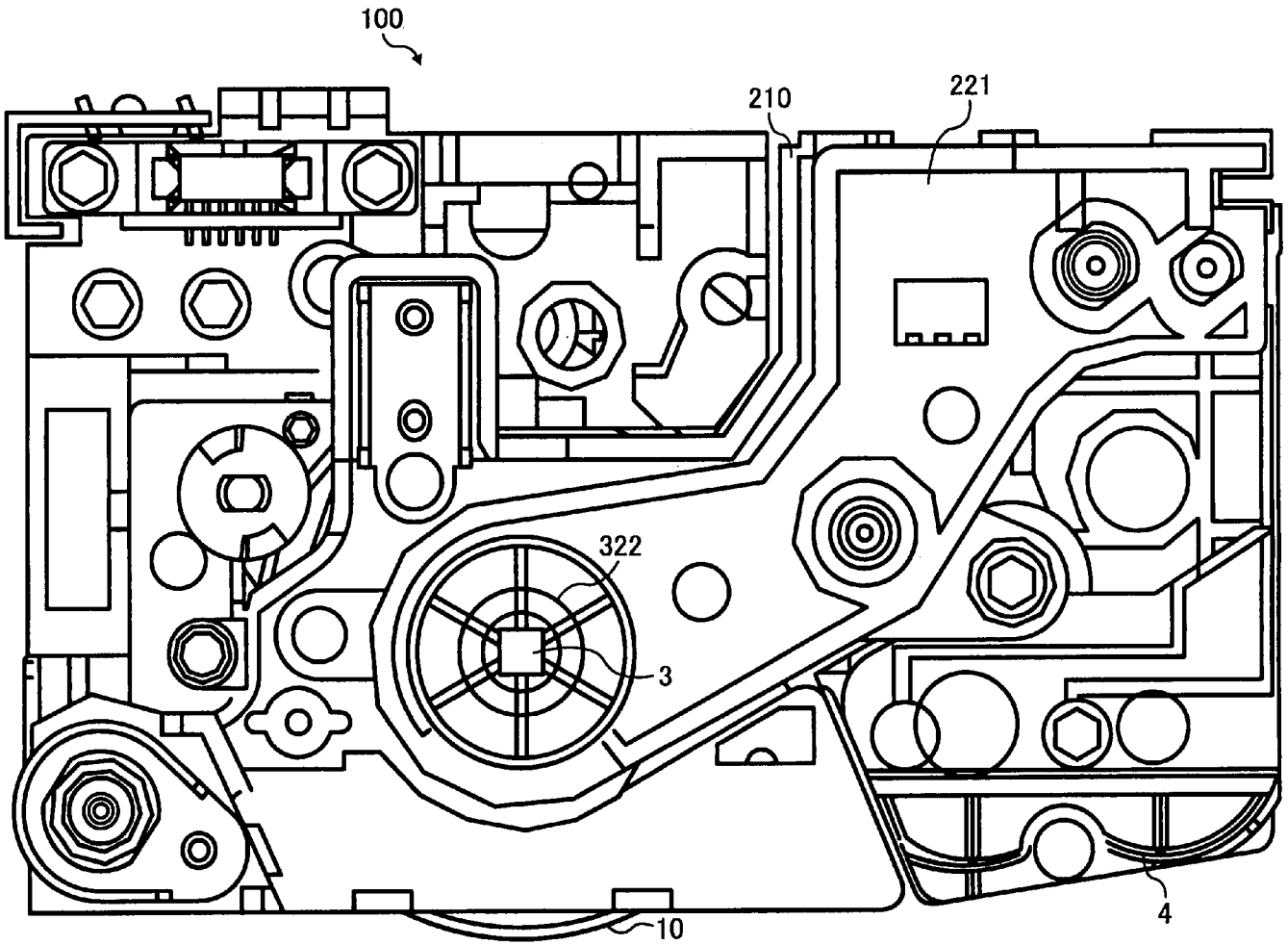
FIG. 5B is another plan view of the process cartridge, seen from a side of a back plate.

FIGS. 5A and 5B are side views of FIGS. 4A and B, in which a photoconductor 10 fixed in the process cartridge 100 by the photoconductor fixing jig 1 is shown. In FIG. 5A, the auxiliary fixing member 2 and the center member 3 of the photoconductor fixing jig 1 appear on the front plate 211. The photoconductor 10 is fixed to a predetermined position enclosed by the process cartridge frame 210. In FIG. 5B, the back touching member 322 and the center member 3 of the photoconductor fixing jig 1 appear on the back plate 221.

The process cartridge 100 according to this exemplary embodiment of the present invention integrally includes a photoconductor as an image carrier and the development unit 4 as a process mechanism, and is configured to be attachable to and detachable from a body of an image forming apparatus. After installed in the image forming apparatus, the process cartridge 100 uses a driving shaft provided in the image forming apparatus as a rotation shaft for driving and rotating the photoconductor 10. More specifically, when the process cartridge 100 is installed in the image forming apparatus, the driving shaft provided in the image forming apparatus is inserted into a center throughhole of the photoconductor 10 that forms a part of the process cartridge 100. The rotation shaft determines a position of the photoconductor 10, and rotationally supports and rotates the photoconductor 10.

Figure 6A:
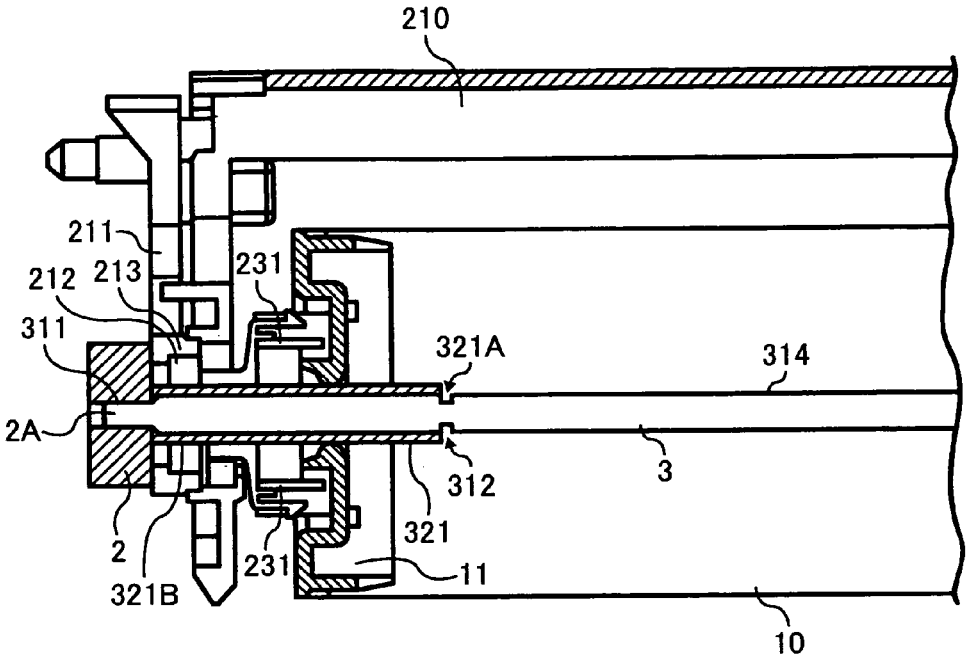
FIG. 6A is a cross-sectional schematic diagram illustrating the process cartridge at the side of the front plate.
Figure 6B:
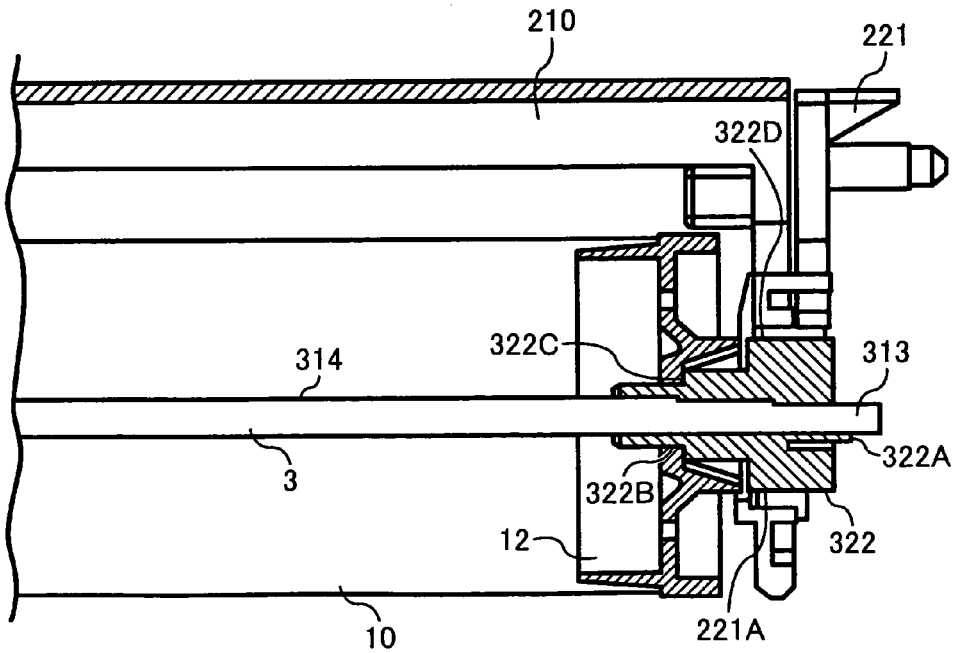
FIG. 6B is a cross-sectional schematic diagram illustrating the process cartridge at the side of the back plate.

FIGS. 6A and 6B are partial cross-sectional diagrams of the process cartridge 100 of FIGS. 4A and 4B. As illustrated in FIG. 6A, the front plate 211 that is a part of the process cartridge frame 210 includes a bearing 212 and a front plate inner periphery surface 213. The photoconductor 10 includes a photoconductor front flange 11, a photoconductor back flange 12, and a hollow center shaft 314; and a compression coil 231 is provided in a left portion of the process cartridge 100. The front touching member 321 further includes a front bearing touching part 321B. The back plate 221 includes a back plate inner periphery surface 221A and a penetration hole (not shown). The back touching member 322 further includes a photoconductor back flange touching part 322B, a back flange pressing part 322C, and a back plate touching part 322D.

The hollow center shaft 314 is a center throughhole of the photoconductor, through which the photoconductor fixing jig 1 penetrates. The bearing 212 is forcibly inserted along the front plate inner periphery surface 213. The front bearing touching part 321B of the front touching member 321 abuts against an inner periphery surface of the bearing 212. Into the front touching member 321, one end of the center member 3 of the photoconductor fixing jig 1 is inserted. The back flange pressing part 322*c* abuts against the photoconductor back flange 12. The back plate inner periphery surface 221A abuts against a part of the back plate touching part 322D of the back touching member 322 fixed to the other end of the center member 3 of the photoconductor fixing jig 1.

The front touching member 321 abuts against the front plate inner surface 213 and an inlet inner periphery surface of a hollow cylindrical part provided at the center of the photoconductor front flange 11. Likewise, the back touching member 322 abuts against the back plate inner periphery surface 221A and an inlet inner surface of a hollow cylindrical part provided at the center of the photoconductor back flange 12. Thus, the photoconductor fixing jig 1 is fixed, and the photoconductor 10 is fixed to the predetermined position, and a positional relationship between the photoconductor 10 and the development unit 4 is maintained with a high degree of accuracy. It is to be noted that an inner diameter of the back plate 221 is larger than an inner diameter of the photoconductor front flange 11 and photoconductor back flange 12.

Next, inserting of the photoconductor fixing jig 1 in the process cartridge 100 is explained in detail.

Figure 7:
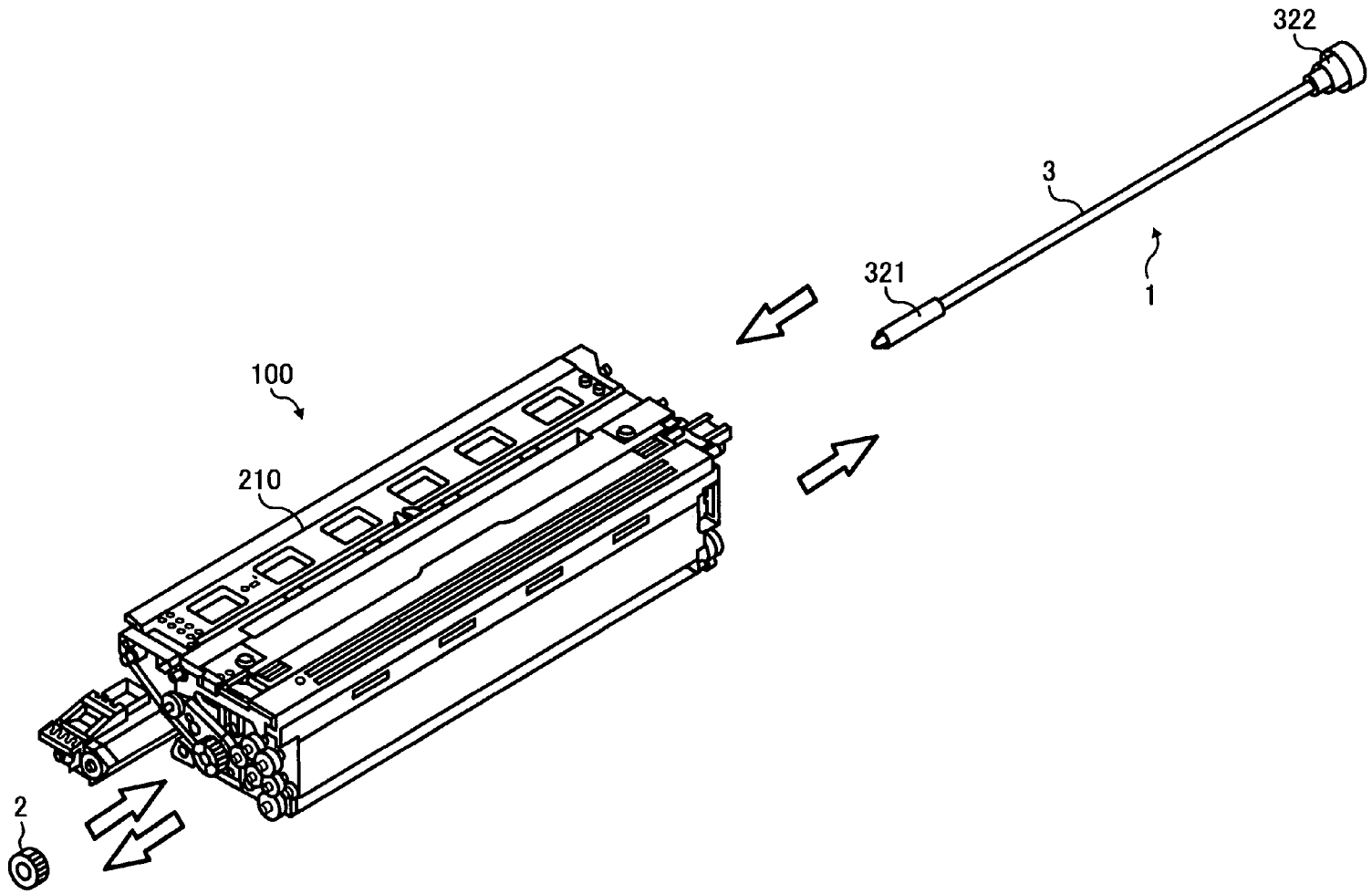
FIG. 7 is an illustration for explaining insertion and removal of the photoconductor fixing jig relative to the process cartridge.

As illustrated in FIG. 7, when the photoconductor fixing jig 1 is inserted in the process cartridge 100, the auxiliary fixing member 2 is removed from the photoconductor fixing jig 1. The center member 3 of the photoconductor fixing jig 1 is inserted into the hollow center shaft 314 of the photoconductor 10 via the penetration hole on the back plate 221 from the end of the front touching member 321 side. The center member 3 protrudes from the bearing 212 attached on the front plate 211 of the process cartridge frame 210. Then, the center member male screw 311 at the end of the center member 3 is screwed into the auxiliary fixing member female screw 2A of the auxiliary fixing member 2. Therefore, the photoconductor 10 is fixed to the process cartridge frame 210. The back touching member 322 abuts against the back plate inner periphery surface 221A and the inlet inner surface of the cylindrical part at the center of the photoconductor back flange 12 with its surface. Further, when the center member 3 is screwed into the auxiliary fixing member 2, the flange pressing part 322C on an edge surface of the back touching member 322 is pressed to an edge surface of the photoconductor back flange 12. As a result, the photoconductor 10 moves forward in the process cartridge 100 (leftward in FIG. 6B). Further, the compression coil 231 applies a rightward force (in FIG. 6A) and a position of the photoconductor 10 in a thrust direction is determined.

Next, installation of the process cartridge 100 in which the photoconductor 10 is attached to the process cartridge frame 210 by the photoconductor fixing jig 1 in the image formation apparatus is explained. Referring to FIG. 7, the auxiliary fixing member 2 is detached from the center member 3 of the photoconductor fixing jig 1 fixed in the process cartridge 100, and the center member 3 is pulled out from the process cartridge 100.

Figure 8A:
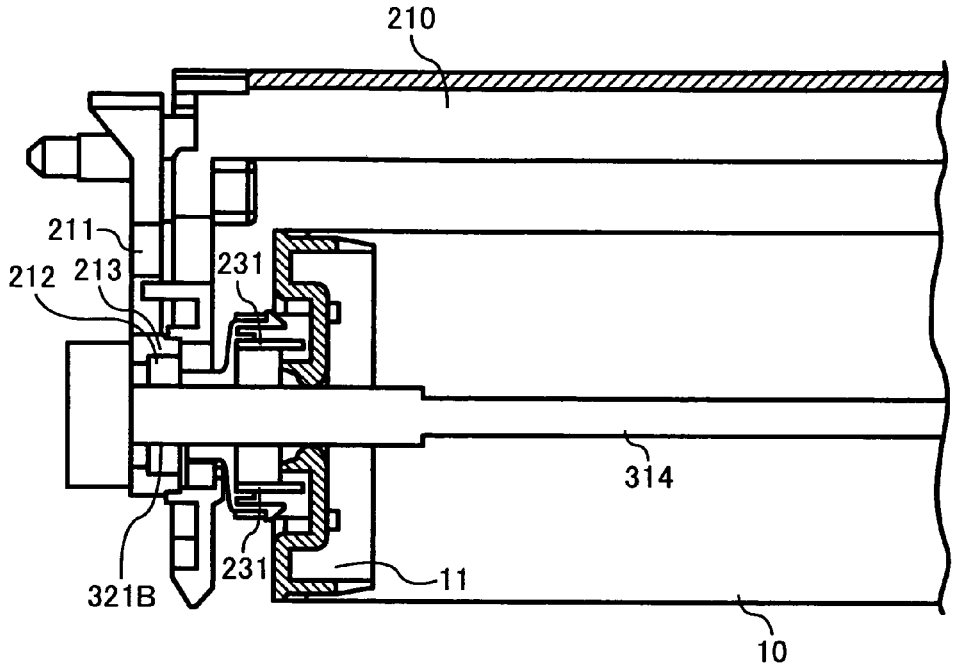
FIG. 8A is a cross-sectional schematic diagram of the process cartridge at the side of the front plate when the photoconductor fixing jig of FIG. 1 is extracted.
Figure 8B:
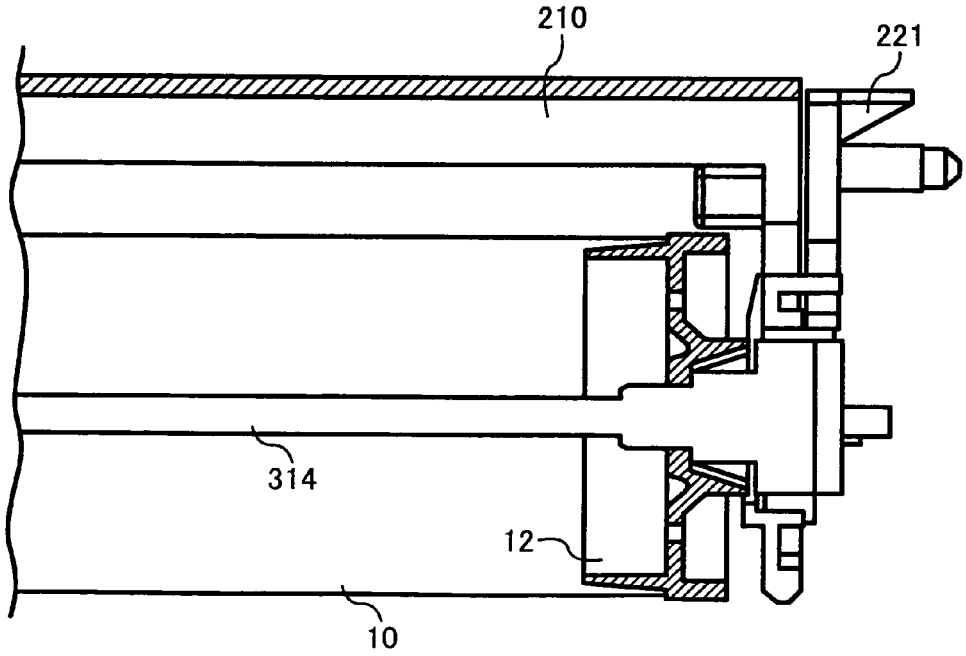
FIG. 8B is a cross-sectional schematic diagram of the process cartridge at the side of the back plate when the photoconductor fixing jig is extracted.

FIGS. 8A and 8B show a state after the center member 3 is pulled out from the photoconductor 10 in the process cartridge 100 of FIGS. 6A and 6B. Instead of the center member 3, the hollow center shaft 314 emerges in the photoconductor 10.

Figure 9:
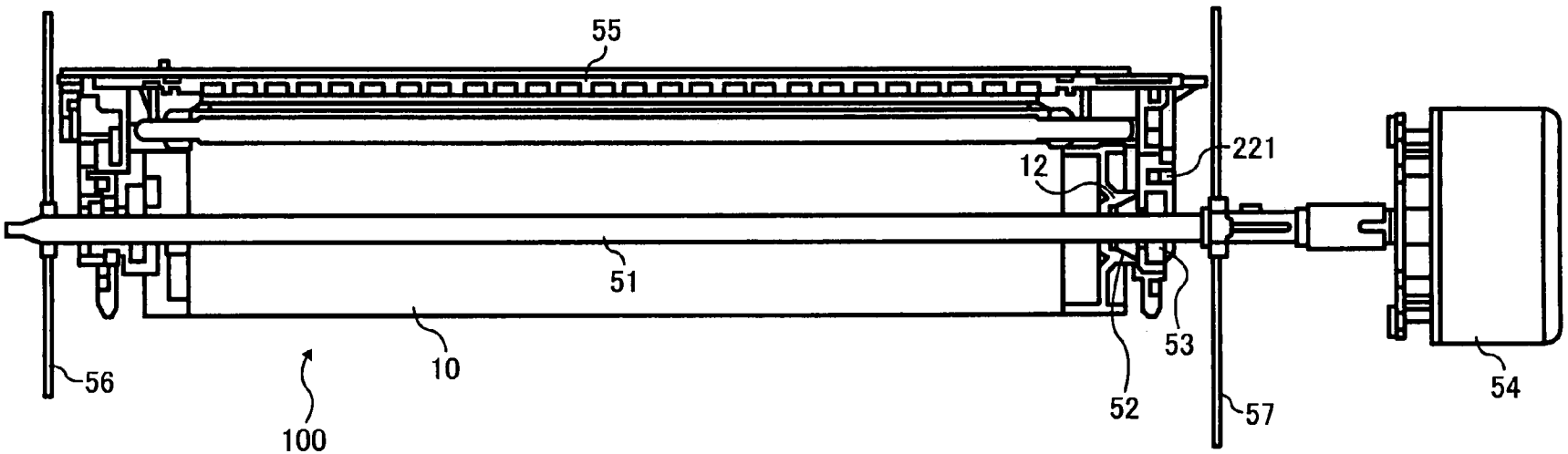
FIG. 9 is a schematic diagram for explaining a state that the process cartridge is installed in an image forming apparatus.

FIG. 9 illustrates a state that the process cartridge 100 including the photoconductor 10 is installed in the image forming apparatus. The image forming apparatus includes a driving shaft 51, a bevel gear 52, a bearing 53, and a driving motor 54. The image forming apparatus further includes a main body slide rail 55, a main body front plate 56, and a main body back plate 57. The driving shaft 51 runs between the main body front plate 56 and main body back plate 57. One end of the driving shaft 51 is connected to the driving motor 54 by using a joint, for example.

The main body front plate 56 is removed before the process cartridge 100 is installed into the image forming apparatus, and is attached to the image forming apparatus after completion of the installation. The process cartridge 100 including the photoconductor 10 is slid along the main body slide rail 55 and fixed at a predetermined position in the image forming apparatus. Then, the driving shaft 51, which is a penetration shaft, is inserted into the photoconductor 10. The photoconductor 10 is engaged with the driving shaft 51 through the bevel gear 52 and bearing 53 that are forcibly fitted on the driving shaft 51. More specifically, the bevel gear 52 of the driving shaft 51 is fitted into an engaging surface of the photoconductor back flange 12. Further, the bearing 53 of the driving shaft 51 is fitted into an engaging surface of the back plate 221 of the process cartridge 100. Thus, the installation of the process cartridge 100 including the photoconductor 10 into the image forming apparatus is completed.

When the photoconductor 10 is attached to the process cartridge frame 210 by using the photoconductor fixing jig 1 as mentioned above, positioning of the photoconductor 10 in radial and thrust directions is performed. The process cartridge 100 is shipped, transported, stored, or otherwise handled in this state.

According to the present invention, as the center member 3 of the photoconductor fixing jig 1 is screwed into the auxiliary fixing member 2, the photoconductor 10 may be securely fixed by the photoconductor fixing jig 1. Further, the photoconductor fixing jig 1 does not become unfastened when the process cartridge 100 is singly transported.

Further, positioning of the photoconductor 10 may be easily performed as the photoconductor 10 is supported by the driving shaft 51 of the body of the image forming apparatus when the process cartridge 100 is installed in the image forming apparatus.

Further, the center member 3 of the photoconductor fixing jig 1 can be produced by cutting and coating a metal. The front touching member 321, auxiliary fixing member 2, and back touching member 322 can be produced by molding a resin. Therefore, production cost may be substantially reduced compared with a case in which the front touching member 321, auxiliary fixing member 2, and back touching member 322 are integrally produced through a cutting processing. Further, stiffness and strength of the photoconductor fixing jig 1 as a whole is maintained high compared with a case in which the front touching member 321, auxiliary fixing member 2, and back touching member 322 are integrally produced by molding a resin.

Numerous additional modifications and variations are possible in light of the above teachings. It is therefore to be understood that within the scope of the appended claims, the disclosure of this patent specification may be practiced otherwise than as specifically described herein.

This patent specification is based on Japanese patent application, No. JP2005-266568 filed on Sep. 14, 2005 in the Japan Patent Office, the entire contents of which are hereby incorporated by reference herein.

The invention claimed is:

1. An image carrier supporter for temporarily fixing an image carrier within a process cartridge of an image forming apparatus during transport and/or storage of the process cartridge, and configured to be removable from the process cartridge for an installation of the process cartridge in the image forming apparatus, the image carrier supporter comprising:

a penetration shaft including first and second ends, and configured to penetrate through a center throughhole of the image carrier;

a first fixing member provided at the first end of the penetration shaft and configured to contact the image carrier and a frame of the process cartridge; and a second fixing member provided at an endmost position of the second end of the penetration shaft and configured to contact the image carrier and the frame of the process cartridge.

2. The image carrier supporter according to claim 1, wherein a first side of the process cartridge corresponding to the first end of the penetration shaft faces outside of the image forming apparatus, and a second side of the process cartridge corresponding to the second end of the penetration shaft faces inside of the image forming apparatus when the penetrating shaft is removed from the process cartridge and the process cartridge is installed in the image forming apparatus.

3. The image carrier supporter according to claim 1, wherein the penetration shaft includes a metal material.

4. The image carrier supporter according to claim 1, further comprising:

auxiliary fixing means detachably attached to the first end of the means for penetrating.

5. The image carrier supporter according to claim 1, further comprising:

a screw member detachably attached to the first end of the penetration shaft.

6. The image carrier supporter according to claim 5, wherein each one of the first and second fixing members and the screw member includes a resin material.

7. A process cartridge configured to be attachable to and detachable from an image forming apparatus, comprising:

a frame;

an image carrier;

an image carrier supporter configured to temporarily fix the image carrier within the process cartridge during transport and/or storage of the process cartridge, and configured to be removable from the image carrier for an installation of the process cartridge in the image forming apparatus, the image carrier supporter including a penetration shaft including first and second ends penetrating through a center throughhole of the image carrier, and a first fixing member provided at the first end of the penetration shaft and configured to contact the image carrier and a frame of the process cartridge;

a second fixing member provided at the second end of the penetration shaft and configured to contract the image carrier and the frame of the process cartridge; and a process mechanism configured to form an image on the image carrier.

8. The process cartridge according to claim 7, wherein the process mechanism includes at least one unit selected from the group consisting of a charging unit for charging a surface of the image carrier, a development unit for supplying a development agent to a latent image formed on the surface of the image carrier to form a visualized image, and a cleaning unit for collecting a remaining development agent on the surface of the image carrier after the visualized image is transferred onto a recording medium.

9. The process cartridge according to claim 7, wherein the image carrier supporter is extracted and a driving shaft of the image forming apparatus is inserted into the center throughhole of the image carrier to closely contact a circumferential inner surface of the image carrier and the frame when the process cartridge is installed in the image forming apparatus, and wherein the image carrier is driven and rotated by the driving shaft of the image forming apparatus.

10. An image carrier supporter for temporarily fixing an image carrier within a process cartridge of an image forming apparatus during transport and/or storage of the process cartridge, and configured to be removable from the image carrier for an installation of the process cartridge in the image forming apparatus, the image carrier supporter comprising:

means, including first and second ends, for penetrating through a center throughhole of the image carrier;

means, provided at the first end of the means for penetrating, for fixedly contacting the image carrier and a frame of the process cartridge; and means, provided at the second end of the means for penetrating, for fixedly contacting the image carrier and the frame of the process cartridge.

11. The image earner supporter according to claim 10, wherein a first side of the process cartridge corresponding to the first end of the means for penetrating faces outside of the image forming apparatus, and a second side of the process cartridge corresponding to the second end of the means for penetrating faces inside of the image forming apparatus when the means for penetrating is removed from the process cartridge and the process cartridge is installed in the image forming apparatus.

* * * * *